US009707148B1

(12) United States Patent
McGuire

(10) Patent No.: US 9,707,148 B1
(45) Date of Patent: Jul. 18, 2017

(54) ATTACHMENT TO A WALKER PROVIDING RETRACTABLE SLIP RESISTANT SURFACES

(71) Applicant: Daniel J. McGuire, Trumbull, CT (US)

(72) Inventor: Daniel J. McGuire, Trumbull, CT (US)

( * ) Notice: Subject to any disclaimer, the term of this patent is extended or adjusted under 35 U.S.C. 154(b) by 0 days.

(21) Appl. No.: 14/697,472

(22) Filed: Apr. 27, 2015

Related U.S. Application Data

(60) Provisional application No. 61/986,772, filed on Apr. 30, 2014.

(51) Int. Cl.
*A61H 3/04* (2006.01)

(52) U.S. Cl.
CPC ..... *A61H 3/04* (2013.01); *A61H 2201/169* (2013.01)

(58) Field of Classification Search
CPC . A61H 3/04; A61H 3/00; A61H 3/008; A61H 2003/005; A61H 2201/164
USPC ..... 135/66–67; 482/66–68, 75–76, 80; 297/423.1, 423.18, 423.25, 423.27, 297/423.34–423.36
See application file for complete search history.

(56) References Cited

U.S. PATENT DOCUMENTS 4,165,127 A * 8/1979 Vago ..... A61G 5/00 280/87.021
4,266,305 A * 5/1981 Kavaloski ..... A61G 5/1002 297/353
4,314,576 A * 2/1982 McGee ..... A61F 5/0104 135/67
4,843,661 A * 7/1989 Skibinski ..... A61G 7/1038 135/67
5,080,383 A * 1/1992 Hsieh ..... A47D 13/043 188/5
5,118,130 A * 6/1992 Kaltz ..... B62B 1/12 211/195
5,148,559 A * 9/1992 Morris ..... A61G 5/00 297/344.21
5,411,044 A * 5/1995 Andolfi ..... A61G 7/1019 135/66
6,860,281 B1 * 3/2005 Clift ..... A61G 7/1038 135/66
7,779,581 B2 * 8/2010 Flaherty ..... E01C 5/20 116/205
7,871,088 B2 * 1/2011 Silva ..... A61G 5/10 135/66

(Continued)

FOREIGN PATENT DOCUMENTS

NZ WO 2005120423 A1 * 12/2005 ..... A61G 7/1038

*Primary Examiner* — Winnie Yip
(74) *Attorney, Agent, or Firm* — Fattibene and Fattibene; Paul A. Fattibene

(57) ABSTRACT

An attachment to a walker that automatically positions a slip resistant surface under the foot of the user. Side-by-side slip resistant surfaces are attached to a walker. A retraction mechanism biases each of the slip resistant surfaces towards the walker. Upon stepping on one of the slip resistant surfaces and advancing the walker the retraction mechanism is extended. When taking a step removing pressure from the slip resistant surface, the slip resistant surface moves towards the walker positioned for receiving the user's foot during another step. Secure footing is obtained on wet or slippery surfaces preventing falls. The attachment is easily folded and closed to be positioned out of the way or removed for storage.

9 Claims, 12 Drawing Sheets

(56) References Cited

U.S. PATENT DOCUMENTS

| | | | | |
|---|---|---|---|---|
| 8,794,252 | B2 * | 8/2014 | Alghazi | A61G 7/10<br>135/66 |
| 2013/0292988 | A1 * | 11/2013 | Jeyasurya | A61G 5/14<br>297/423.26 |

* cited by examiner

ATTACHMENT TO A WALKER PROVIDING RETRACTABLE SLIP RESISTANT SURFACES

RELATED APPLICATION

This application claims the benefit of U.S. Provisional Application No. 61/986,772 filed Apr. 30, 2014.

FIELD OF THE INVENTION

The present invention relates in general to assisting individuals in their mobility and walking, and particularly to providing secure footing for individuals using walkers on slippery surfaces.

BACKGROUND OF THE INVENTION

Walking aids are used by many people. Many elderly people use canes or walkers to provide needed stability and to prevent falling. Walkers have been developed that have four wheels and even provide the convenience of a seat and brakes. The walkers often fold for easy transport and to be readily available when needed. Walkers have greatly facilitated the mobility of many individuals, but they are often of little help in slippery conditions. For example on wet, snowy, or icy surfaces a walker provides no help in preventing a person's foot from slipping and causing a fall. Therefore, there is a need for a device that can easily be use with a walker and that assures that the user has secure footing always under their feet as the walker is moved and the user steps forward.

SUMMARY OF THE INVENTION

The present invention provides an attachment to a conventional or standard walker that provides a slip resistant surface that is automatically positioned under the user's foot as the walker is advanced or moved forward. Movable slip resistant surfaces are attached to support bars which are removably attached to a frame of a walker. The slip resistant surfaces are attached to a retraction means for selectively pulling the slip resistant surfaces towards the walker when the pressure of a user's foot is removed. As the user moves the walker forward the slip resistant surfaces are alternately moved into position under the user's foot by the retraction means for selectively pulling the slip resistant surface towards the walker. The attachment can be folded and closed to be positioned out of the way on the walker or removed and stored until needed.

It is an object of the present invention to provide secure footing for a user of a walker on slippery surfaces, such as when walking in wet, icy, or snowy conditions.

It is another object of the present invention that is easy to use and attach to a walker.

It is an advantage of the present invention that it can be attached to an existing walker without the need to modify the walker.

It is another advantage of the present invention that it can be easily folded to be positioned out of the way on the walker when not in use.

Is a feature of the present invention that a retractable cord automatically positions a slip resistant surface under a user's foot.

It is another feature of the present invention that the slip resistant surfaces move independently from one another.

It is another feature of the present invention that the retractable cord can be selectively detached from the slip resistant surface permitting the slip resistant surface to be folded and closed to be compactly stored.

These and other objects, advantages, and features will become more readily apparent in view of the following more detailed discussion.

DETAILED DESCRIPTION OF THE INVENTION

A walker, is generally used for individuals that may have difficulty walking and require some additional support to prevent falling. The present invention provides secure footing and improved stability for an individual using a walker on a slippery surface. At times, a walker may need to be used on surfaces that are wet, icy, slippery or uneven. When a walker is used in conditions where the walking surface may be slippery, such as when the walking surface is wet or icy, an individual having to step directly on the slippery surface may be much more prone to slipping or falling despite the use of the walker. The present invention provides a solution to the problem of using a walker on a slippery surface.

Figure 1:
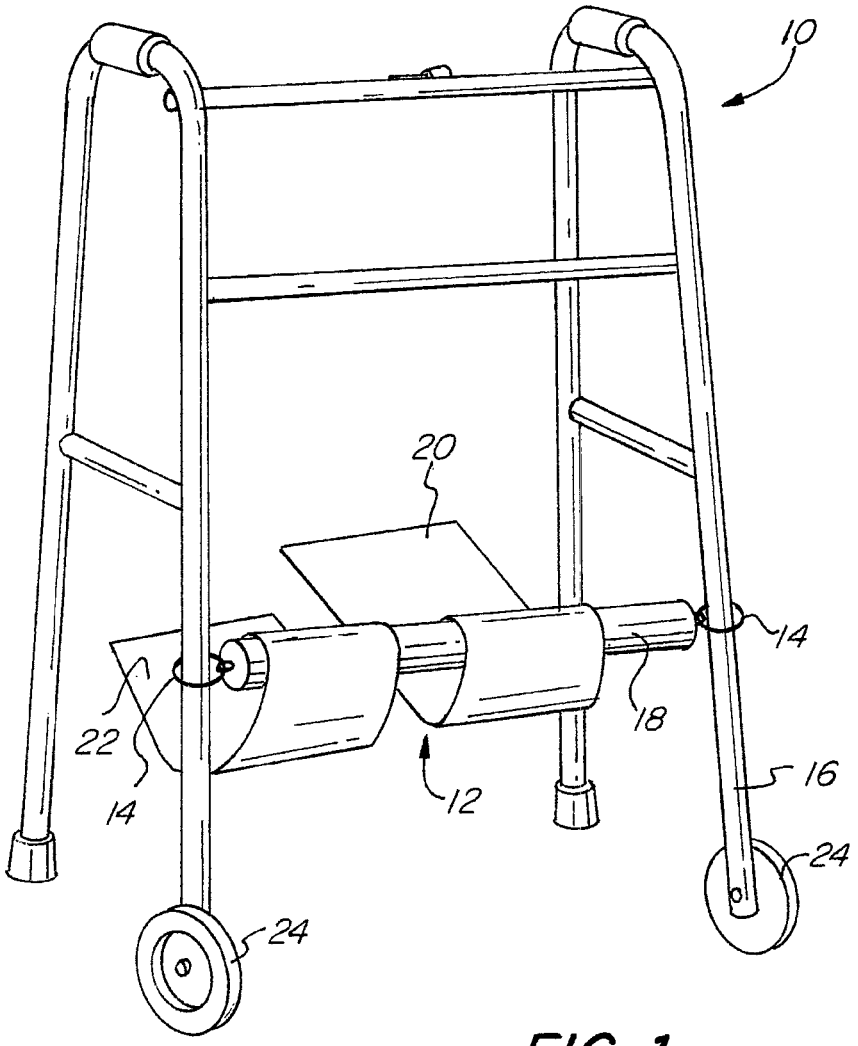
FIG. 1 schematically illustrates an embodiment of the present invention.

FIG. 1 schematically illustrates the present invention attached to a walker 10. A slip resistant surface attachment 12 is attached to a leg 16 of the walker 10 with an attachment clip or means for attaching 14. The attachment 12 comprises a roller or cylinder 18 and a slip resistant surface or pad 20 and 22. The walker 10 may have wheels 24.

The attachment 12 is securely connected to the walker 10 by the attachment clips 14 and may be easily removed and stored when not needed. Preferably, there are two slip resistant surfaces 20, 22 that move independently corresponding to each foot of the user. The slip resistant surfaces 20, 22 are rolled up on the roller or cylinder 18. An internal spring may be used with a ratcheting mechanism, such as used in a common window shade, to extend and retract the slip resistant surfaces 20, 22. Additionally, the roller or cylinder 18 may be bifurcated or made up of two individual rollers or cylinders that rotate independently so that the two slip resistant surfaces 20, 22 may be moved independently following the movement of each of the user's feet.

The present invention provides a device that greatly improves the stability of a user using a walker on a wet, slippery, or icy surface. The present invention assures that a user is always walking on a slip resistant surface. Means may be used for adjusting the tension or force in which the slip resistant surface is extended or retracted. The slip resistant surface may also be rolled up and detached from the walker for convenient storage when not needed. A knob may be used to assist rolling up the slip resistant surface onto the roller or cylinder. A locking device may also be used to prevent movement of the slip resistant surface from rolling and unrolling on the roller or cylinder.

Figure 2:
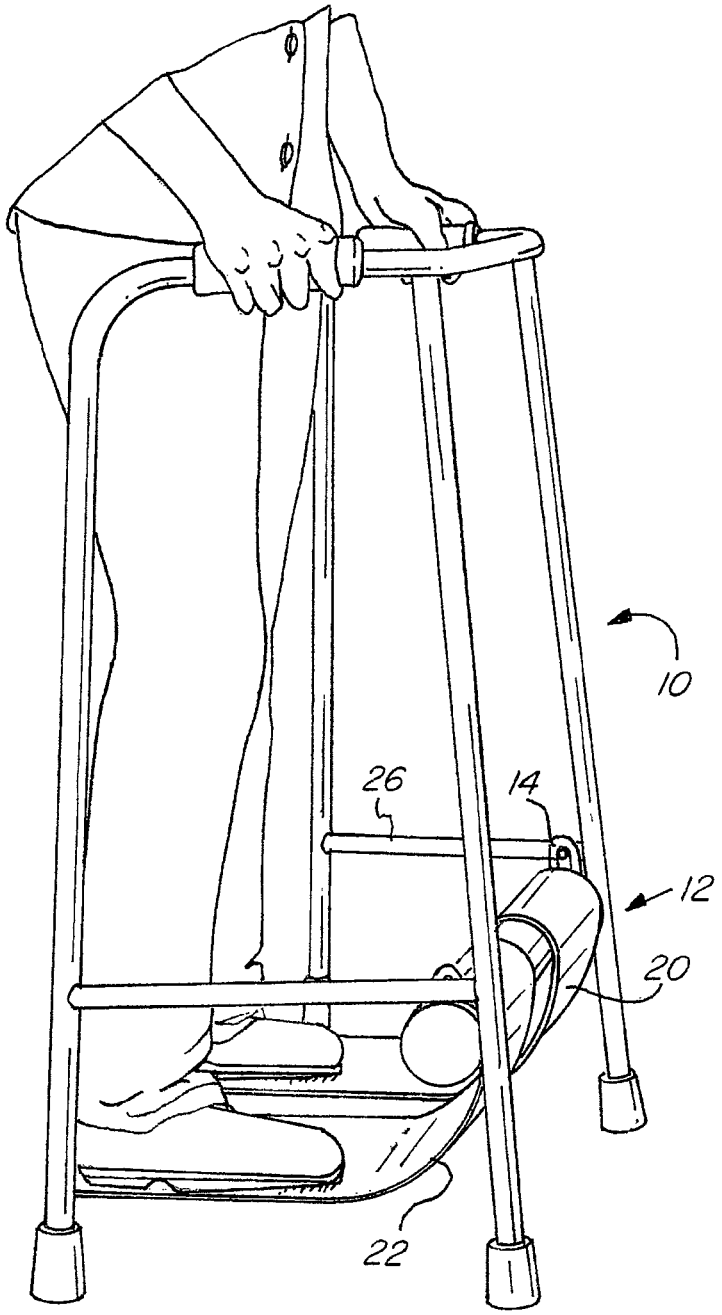
FIG. 2 illustrates use of a walker by a user with the present invention attached.

FIG. 2 more clearly illustrates use of the present invention by a user and the placement of a user's foot on one of the slip resistant surfaces 22. In FIG. 2, the slip resistant surface attachment 12 is attached to a horizontal bar 26 of the walker with the attachment clip or means for attaching 14. As the user walks and placing their foot on one of the slip resistant surfaces 20 and 22, and advances the walker forward the slip resistant surfaces 20 and 22 will extend and retract following the user's feet. This may be accomplished by a bias spring and a ratchet mechanism incorporated within the roller 18 such that when pressure by the user's foot is applied to the slip resistant surface 20 or 22, it will extend and when pressure is released by movement of the user's foot it will retract a predetermined distance to become positioned for the user's next step.

Figure 3:
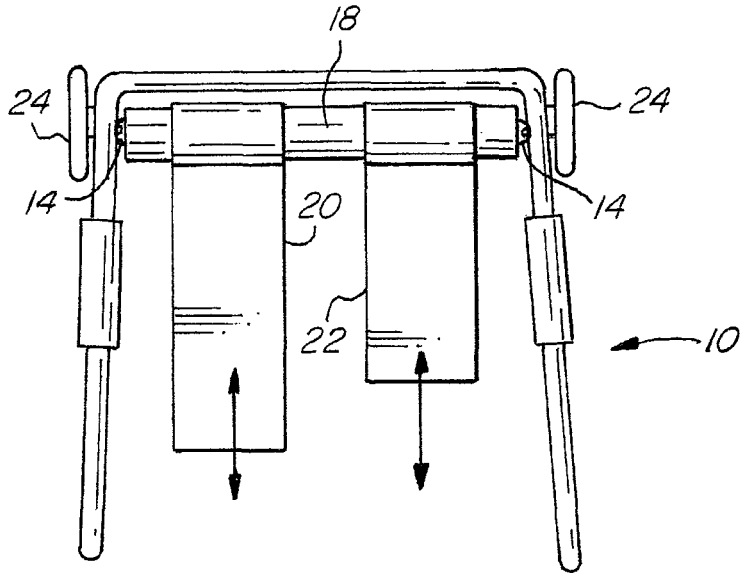
FIG. 3 is a plan view illustrating the present invention.

FIG. 3 is a plan view illustrating the walker 10 with the attachment 12 attached thereto. FIG. 3 illustrates the different amount of retraction and extension of the slip resistant surfaces 20 and 22. The movement of the slip resistant surfaces 20 and 22 are represented by the arrows.

Figure 4:
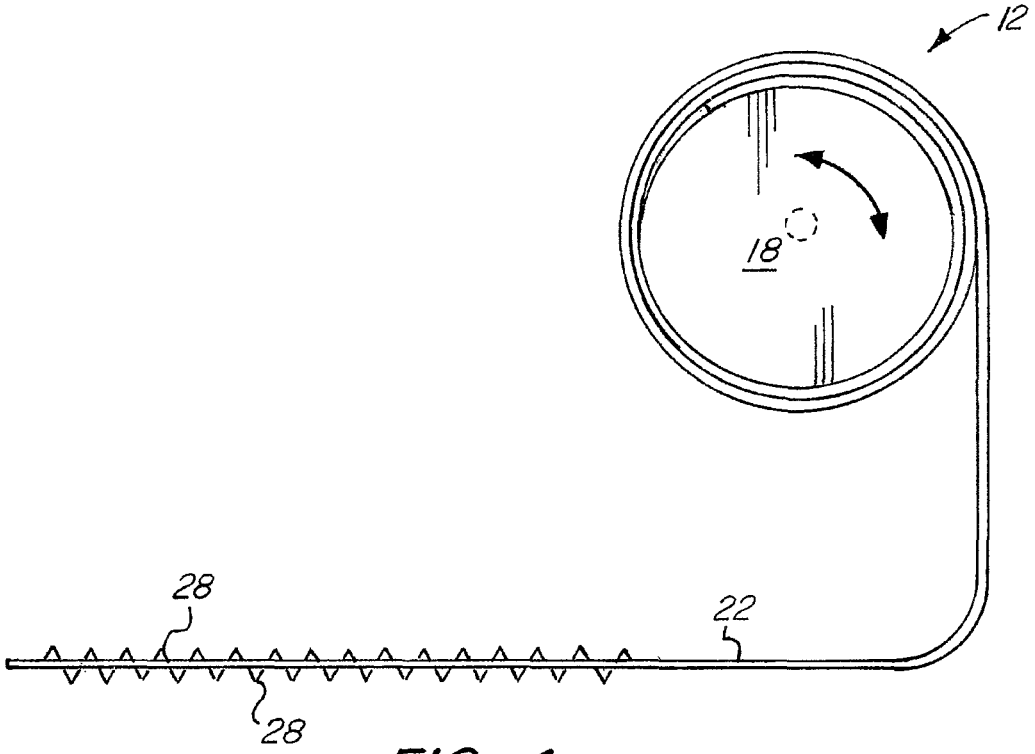
FIG. 4 is a side elevational view illustrating the present invention.

FIG. 4 is a side elevational view illustrating the slip resistant surface 22 rolled up on the roller or cylinder 18 in the direction of the arrow placed thereon. FIG. 4 also illustrates an embodiment that has cleats 28 placed on the slip resistant surface 22 on either the top or bottom surface or both. Any form or shape of cleat 28 may be used. Additionally, the slip resistant surface maybe made of rubber, plastic, fabric or any flexible material that provides a slip resistant surface and that is capable of being rolled.

Figure 5:
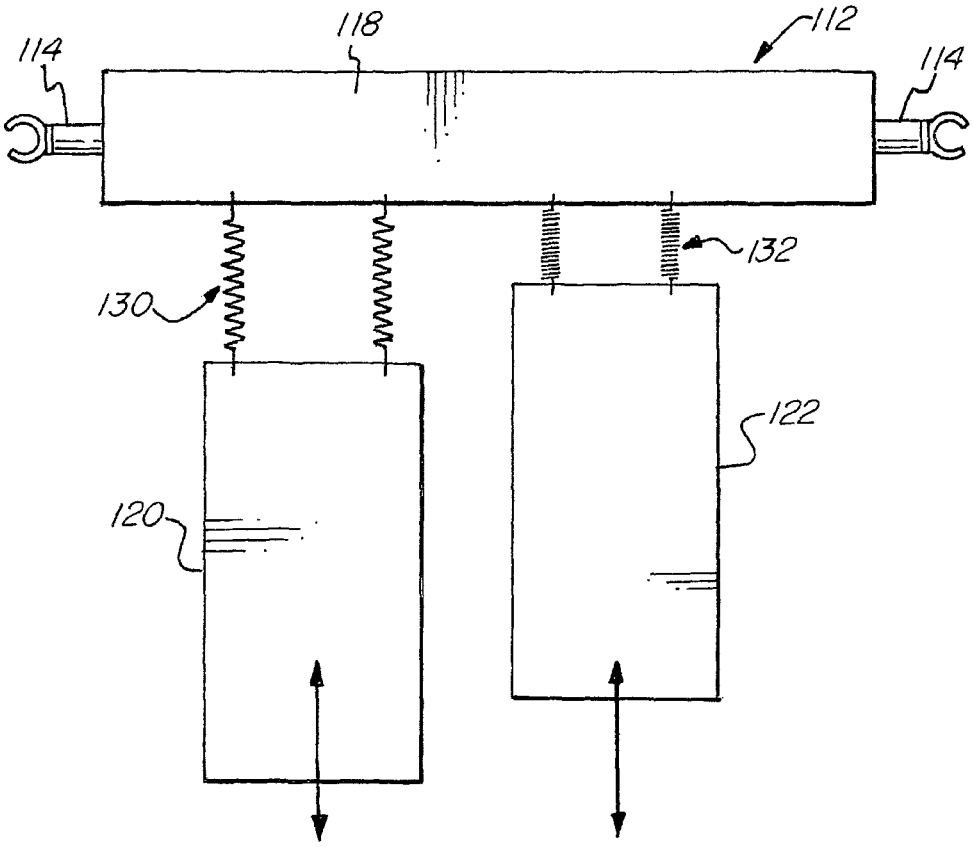
FIG. 5 is a plan view illustrating another embodiment of the present invention.
Figure 6:
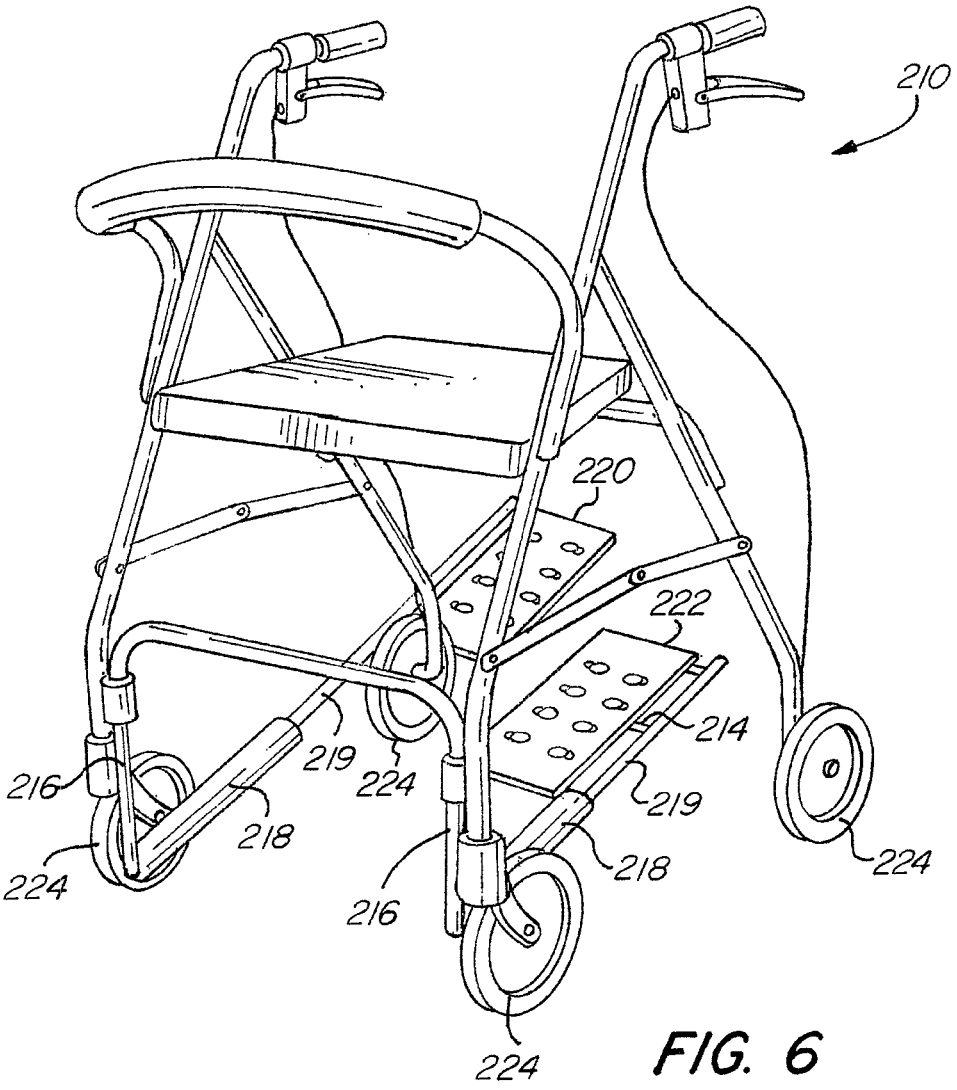
FIG. 6 is a perspective view schematically illustrating another embodiment of the present invention.

FIG. 5 illustrates another embodiment of the present invention utilizing a spring or other equivalent means for retracting and extending or moving the slip resistant surfaces 120 and 122. In this embodiment the slip resistant surface attachment 112 comprises a bar or cylinder 118 having attachment clips 114 placed on either end. Attached to the bar 118 intermediate the ends thereof are spring means for extending and retracting the slip resistant surfaces 120 and 122 and permitting them to move in the direction of the arrows. Accordingly, when the user's foot applies pressure to one of the slip resistant surfaces 120 and 122, the slip resistant surface 120 or 122 will extend biasing the spring means 130 or 132. When the user's foot is raised for taking a step pressure is released from the slip resistant surface 120 or 122 and the spring means 130 or 132 causes the slip resistant surface 120 or 122 to retract or move forward placing it in position for the user's next step. In this way it is assured that the user will always have a slip resistant surface under their feet when walking forward.

FIGS. 6-9 illustrate another embodiment of the present invention. This embodiment of the invention has been adapted to a walker 210 having four wheels 224. The four wheeled walker 210 has a frame with an attached cylinder support 216 adjacent each front wheel 224. Cylinders 218 are attached to the cylinder support adjacent the two front wheels 224. The cylinders 218 may be attached by other means. Cylinders 218 each contain a piston and spring. The piston is attached to a piston rod 219. A piston rod 219 is attached to a first slip resistant surface 220 and the other piston rod 219 is attached to a second slip resistant surface 222. That is, the first and second slip resistant surfaces 220 and 222 are attached to a respective one of the piston rods 219. The piston rods 219 are biased by a spring so as to position the first and second slip resistant surfaces 220 and 222 underneath the frame of the walker 210. Upon a person stepping onto one of the first or second slip resistant surfaces 220 or 222 and the walker is moved forward the piston rod 219 will be extended rearward compressing a spring within the cylinder 218. Upon removing one's foot from either the first or second slip resistant surfaces 220 or 222 the spring bias will cause of the slip resistant surface 220 or 222 to retract under the frame of the walker 210 and to be reset in a position for a person to take another step. Therefore, one of the first or second slip resistant surfaces 220 or 222 will always be in position to be stepped upon by the person as the person walks forward with the walker 210. The slip resistant surfaces 220 and 222 are attached to the piston rod 219 with an attachment clip or bracket 214. The attachment clip or bracket 214 may comprise a pivot so that the slip resistant surfaces 220 and 222 may be rotated vertically 90° to be positioned out of the way when not intended to be used.

Figure 7:
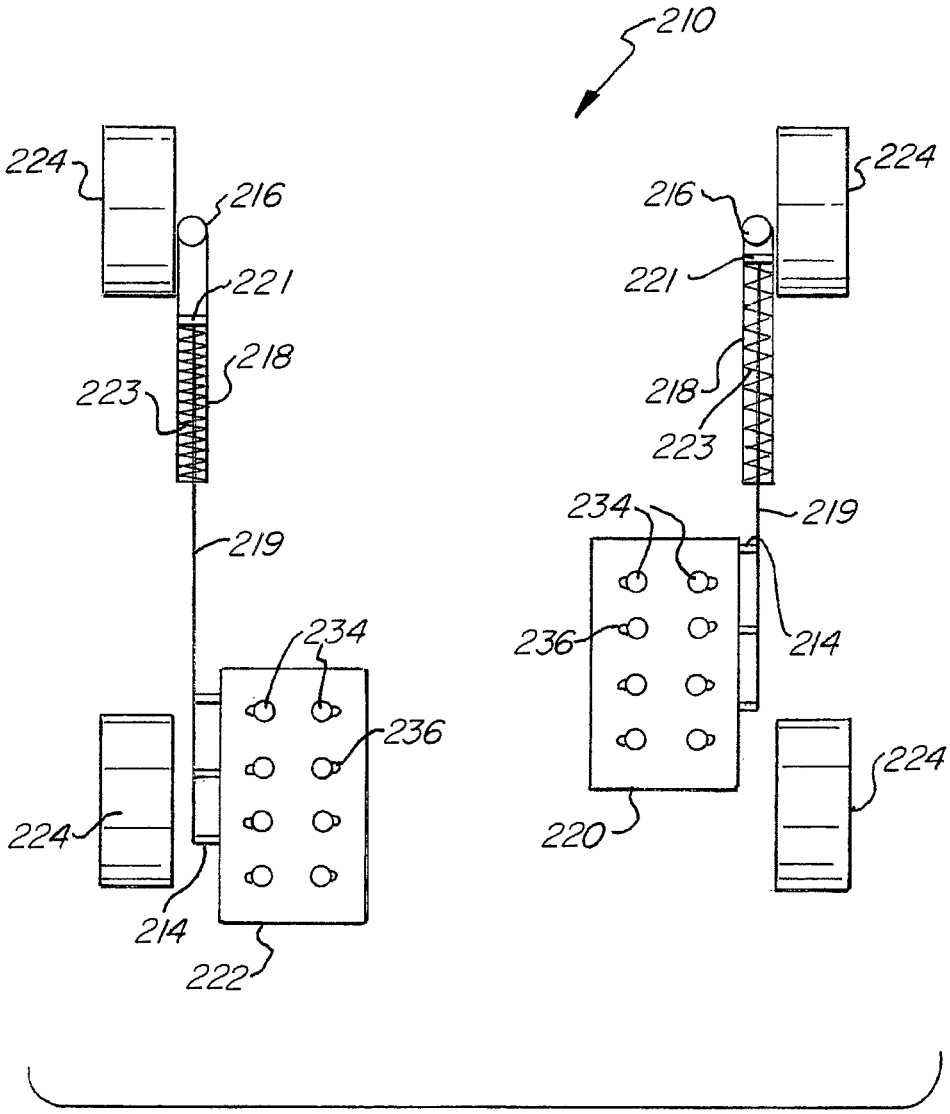
FIG. 7 is a plan view schematically illustrating the embodiment illustrated in FIG. 6.

FIG. 7 is a plan view schematically illustrating the operation of this embodiment of the present invention. Adjacent the front wheels 224 of the walker 210 are cylinder supports 216. The cylinders 218 contain a piston 221 and a coil or helical spring 223 placed around the piston rod 212. The spring 223 is trapped between the piston 221 and the end of the cylinder 218 from which the piston rod 219 extends. Accordingly, when the slip resistant surface 222 is stepped on and held in position by the friction between the ground and the slip resistant surface 222 and with the walker 210 moving forward the piston rod 219 extends compressing the spring 223. Upon stepping off of the slip resistant surface 222 the slip resistant surface will move forward closer to the front wheels 224 as the spring 223 forces the piston 221 to retract further within the cylinder 218.

Slip resistant surface 220 is in a retracted position under the walker 210 with the spring 223 biasing the piston 221 close to the front wheel 224 and in a position ready to be stepped upon once again prior to advancing the walker 210 forward. Accordingly, this function assures that a slip resistant surface 220 or 222 is always in position under a person's foot as they walk advancing the walker 210 forward. This assures that a person always has secure footing even under slippery conditions, such as on ice, snow, or wet surfaces. The slip resistant surfaces 220 and 222 preferably have cleats 234 placed within keyhole openings 236. The cleats 234 provide a sure grip on icy, snowy, or wet surfaces.

Figure 8:
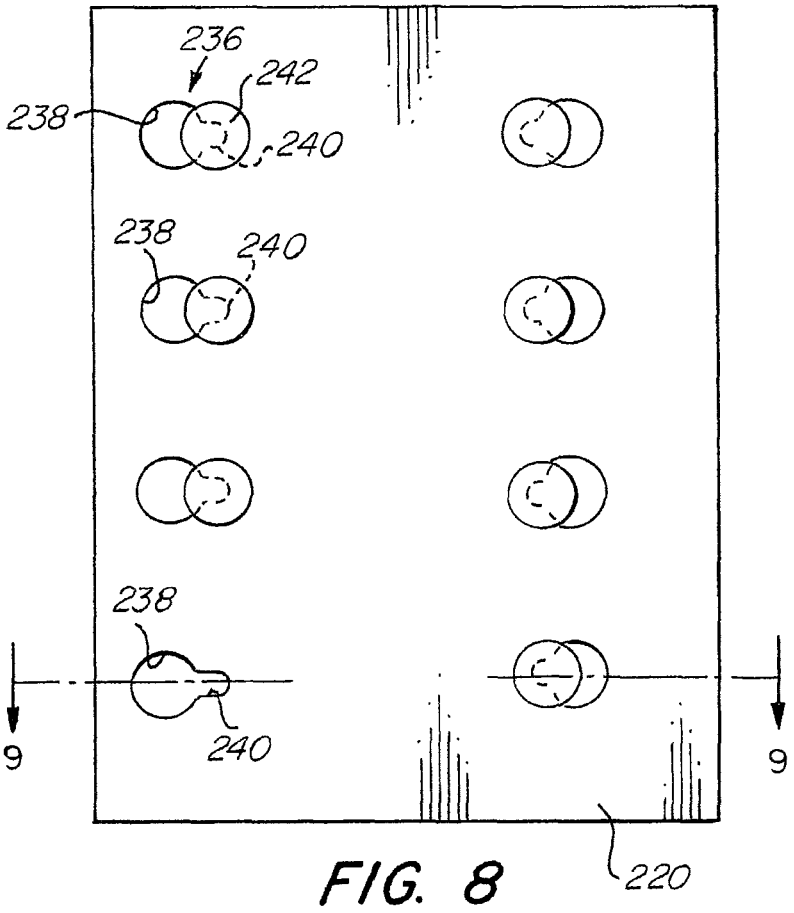
FIG. 8 is a plan view of one of the slip resistant surfaces illustrated in FIGS. 6-7 showing attachment of cleats.
Figure 9:
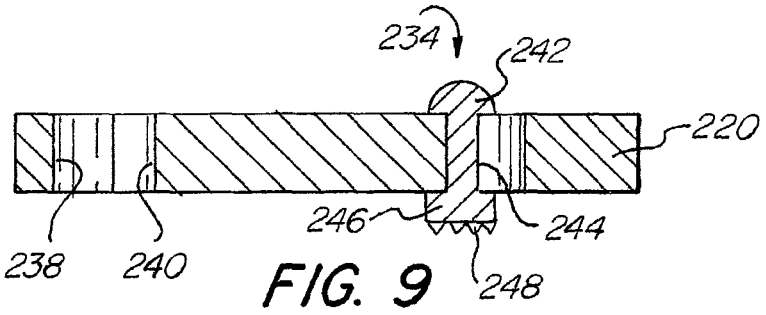
FIG. 9 is a cross section taken along line 9-9 in FIG. 8.

FIGS. 8 and 9 more clearly illustrate the cleats 234 attached to a slip resistant surface 220. As illustrated in FIG. 9, the cleat 234 comprises a cleat head 242, cleat body 244, cleat base 246 with attached cleat spikes 248. The cleat head 242 or cleat base 246 may be placed in and through the circular portion 238 of a cleat opening keyhole 236. The cleat 234 is then slid sideways or longitudinally so that the cleat body 244 fits within the slot portion 240 of the cleat opening keyhole 236. The slot portion 240 may form a friction fit with the cleat body 244 to securely hold the cleats 234 in position. This structure permits the cleats 234 to be easily removable and replaced should the spikes 248 be damaged.

Figure 10A:
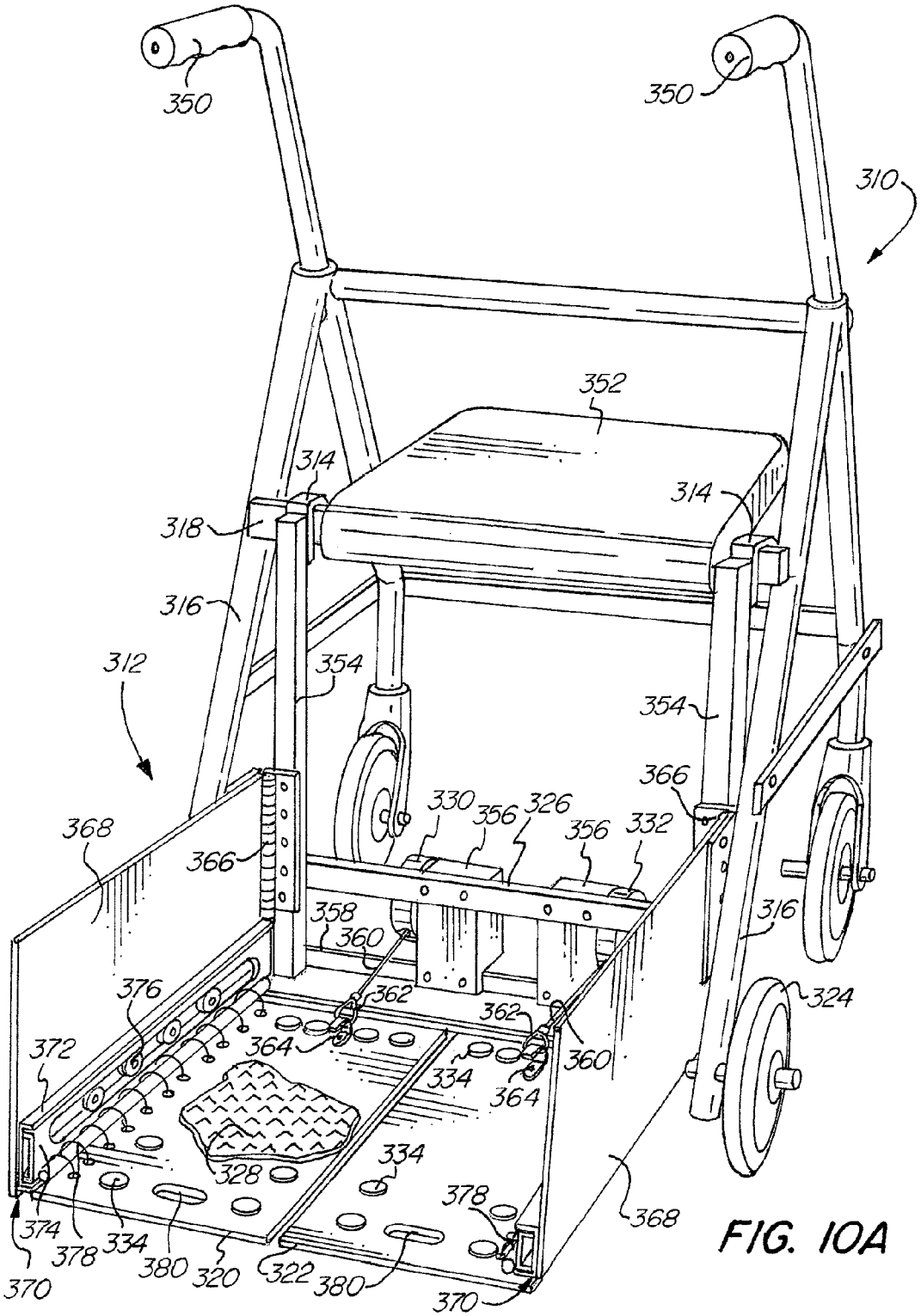
FIG. 10A is a perspective view illustrating an embodiment of the present invention having slip resistant retractable surfaces attachment in an open or ready to use position.
Figure 10B:
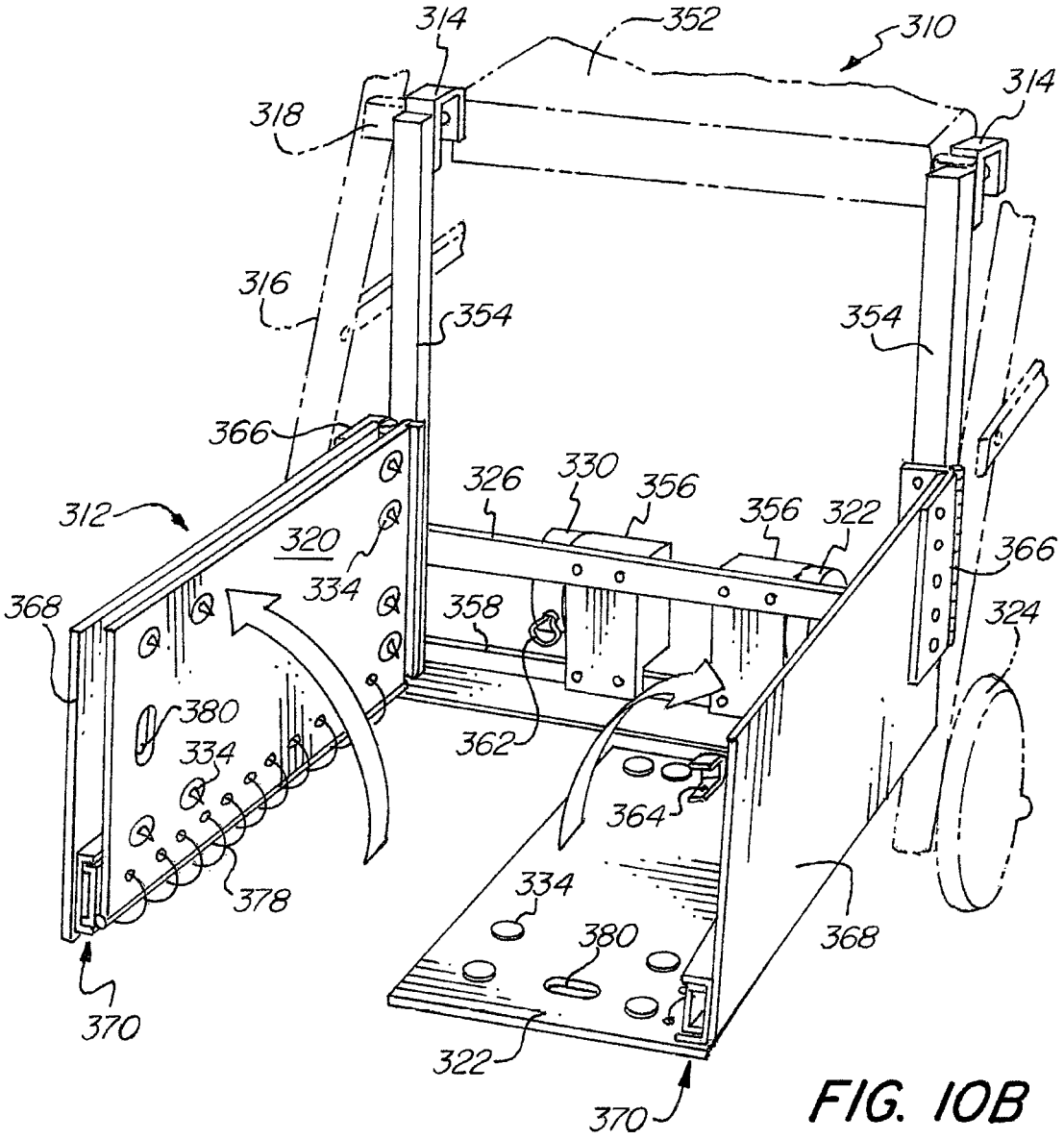
FIG. 10B is a perspective view of the embodiment of the present invention illustrated in FIG. 10A with one slip resistant surface folded up.
Figure 10C:
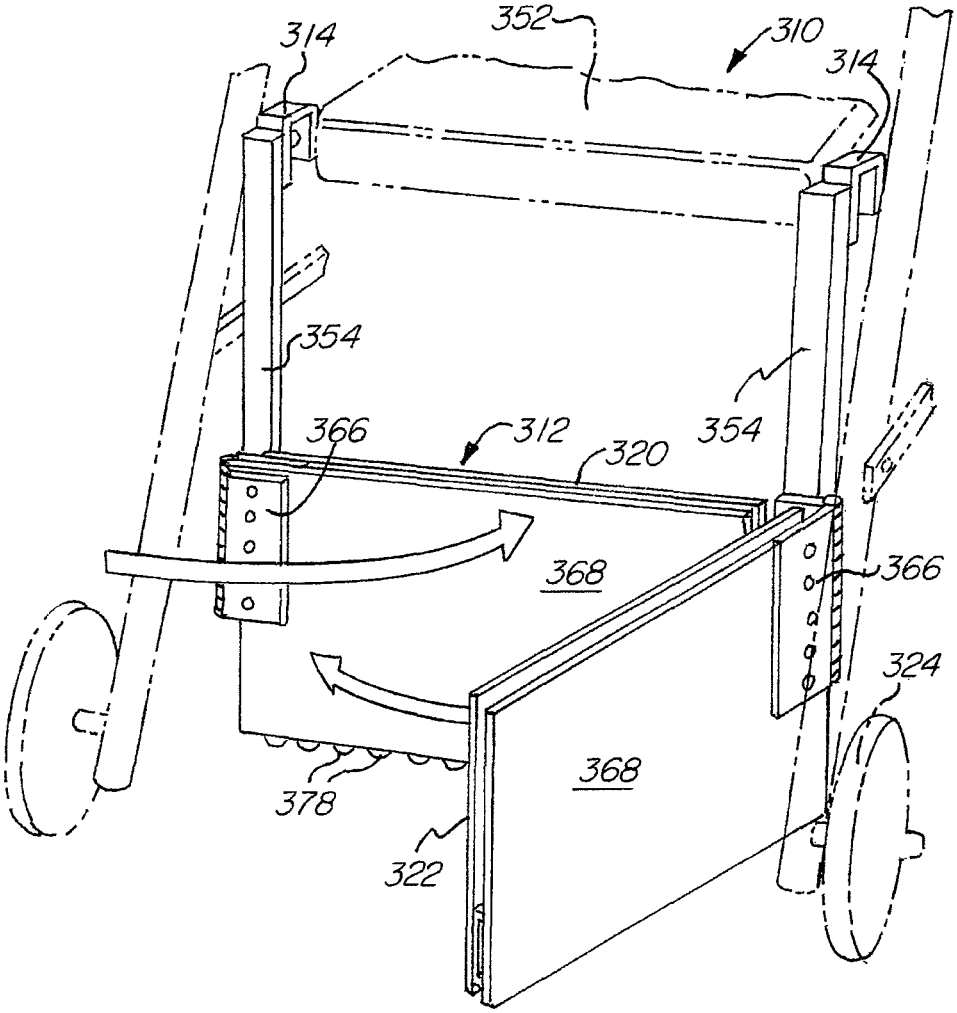
FIG. 10C is a perspective view of the embodiment of the present invention illustrated in FIGS. 10A-B with the slip resistant surfaces folded up and partially closed in a stored position.

FIGS. 10A-C illustrate a preferred embodiment of the present invention in different positions. FIG. 10A-C illustrates the preferred embodiment of the present invention in an open position, a partially folded position, and a partially closed position.

FIG. 10A illustrates the present invention in an open and unfolded operating position ready for use. The slip resistant retractable surface attachment 312 is attached to a walker 310. The walker 310 may have handles 350 and a seat 352. Attachment hooks 314 or other means for attaching are attached to a hook support bar 318 attached to legs 316 of the walker 310. Vertical attachment bars 354 extend from the hooks 314 downward to in upper support bar 326 and a lower support bar 358. The vertical attachment bars are perpendicular to the upper and lower support bars 326 and 358. Attached to the vertical attachment bars 354 are side hinges 366. Attached to the upper and lower support bars 326 and 350 are support boxes 356. A first retractable cord spring 330 is attached to one of the support boxes 356 and a second retractable cord spring 332 is attached to the other support box 356. The retractable cord springs 330 and 332 may be any spring capable of biasing or pulling towards the walker 310, such as a coiled spring. Wound within each of the retractable cord springs 330 and 332 are retractable cords 360. The retractable cord springs 330 and 332 bias the retractable cords 360 inward so that they are normally wound or coiled. Each of the retractable cord springs 330 and 332 has a loop 362 on the distal end. The loops 362 are adapted to selectively connect and disconnect from catches 364. The catches 364 are attached to respective slip resistant surfaces 320 and 322. The slip resistant surfaces 320 and 322 are connected to slides 370 by surface hinges 378. The slides 370 have inner channels 374 connected to the surface hinges 378 and outer channels 372 attached to sides 368. Slide wheels 376 or place between the outer channels 372 and the inner channels 374 so that the inner channels 374 and the outer channels 372 easily move relative to one another. This permits the slip resistant surfaces 320 and 322 to move back and forth relative to the sides 368 and against the bias of the retractable cords 360. Each of the slip resistant surfaces 320 and 322 has removable and replaceable cleats 334 placed therein. The cleats 334 have a button top surface and a spike on the bottom extending through the slip resistant surfaces 320 and 322. The cleats may be of a structure as illustrated in FIGS. 8 and 9. A textured surface or non-slip carpet 328, only a portion of which is illustrated in FIG. 10A on slip resistant surface 320, may be placed on the slip resistant surfaces 320 and 322 to provide additional comfort and traction when a foot is placed thereon. Each of the slip resistant surfaces 320 and 322 may have an opening or hole 380 therein to facilitate lifting of the respective slip resistant surfaces 320 and 322. A handle with a hook, not illustrated, may be provided or attached to the walker 310 or the slip resistant retractable surface attachment 312 to facilitate lifting of the slip resistant surfaces 320 and 322 without having to bend over.

FIG. 10B illustrates the present invention in a partially folded position. The surface hinge 378 permits the slip resistant surface 320 to be folded up adjacent the side 368. The other side slip resistant surface 322 may also be folded upward as illustrated by the arrow. The spikes on the cleats 334 are more clearly illustrated on the bottom surface of the folded up slip resistant surface 320. The cleats 334 may be any commercially available cleat 334 and are easily replaceable. The cleat may also be of a structure and attached to the slip resistant surfaces 320 and 322 as illustrated in FIGS. 8-9.

FIG. 10C illustrates the present invention in a partially closed position. Once the slip resistant surfaces 320 and 322 are folded upward against the respective sides 368 the slip resistant surfaces 320 and 322 and the sides 368 may be closed about respective side hinges 366 so that the slip resistant retractable surface attachment 312 is folded and closed so as to be out of the way. The slip resistant retractable surface attachment 312 can then be conveniently stored on the walker 310 in a folded and closed position and retracted in a compact location that does not extend beyond the wheels 324. The slip resistant retractable surface attachment 312 may also be lift in the folded and closed position or removed if not intended to be used.

FIGS. 10 B-C illustrate how the slip resistant retractable surface attachment 312 can be conveniently folded and closed for storage. When not needed, the loop 362 is unhooked from the catch 364 permitting the slip resistant surfaces 320 and 322 to be folded upward. After the slip resistant surfaces 320 and 322 are folded upward the sides 368 are closed inward. The structure of the embodiment illustrated in FIGS. 10A-C permit the slip resistant retractable surface attachment 312 to be left in position on the walker 310 until needed or removed from the walker 312 and stored.

The operation of the present invention is readily appreciated from FIGS. 10A-C. The slip resistant retractable surface attachment 312 illustrated in FIG. 10A is in a position ready for use. The slip resistant surfaces 320 and 322 are folded down in position with the retractable cords 360 attached to the catches 364 by loops 362. As the walker 310 is moved forward the slip resistant surfaces 320 and 322 are permitted to move back and forth longitudinally along slide 370. When a foot is placed on one of the slip resistant surfaces 320 or 322 the pressure from a foot will hold a respective one of the slip resistant surfaces 320 and 322 in position while the walker 310 is advanced forward. The retractable cord 360 will be pulled out against the bias of the respective retractable cord springs 330 or 332. Upon the lifting of a foot to step forward the pressure on the respective slip resistant surface 320 and 322 is removed permitting the bias force from the retractable cord springs 330 or 332 to pull the respective slip resistant surfaces 320 or 322 forward so as to place it in position for another step. In this way, as the walker 310 is advanced by the user there is always a slip resistant surface 320 or 322 in position to receive the placement of a user's foot. The longitudinal length of the slip resistant surfaces 320 and 322 in combination with the range of motion of the slides 370 should be sufficient so as to accommodate a person's gate or stride so as to assure that each respective slip resistant surface 320 and 322 are in position during the user's natural gate, pace, or stride.

Figure 11A:
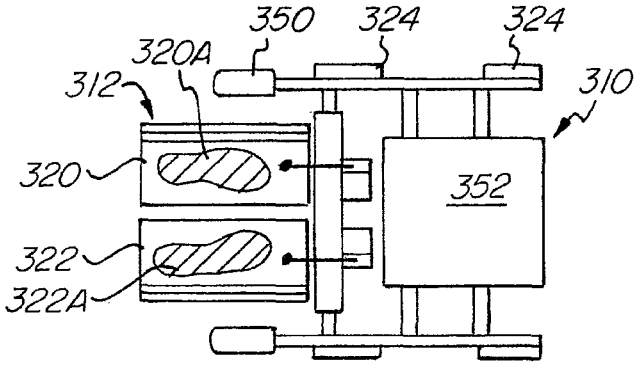
FIGS. 11A-F schematically illustrate the operation of the present invention illustrated in FIGS. 10A-C.
Figure 11B:
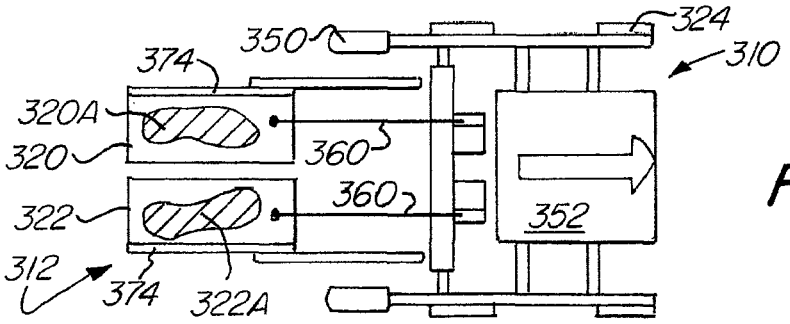
Figure 11C:
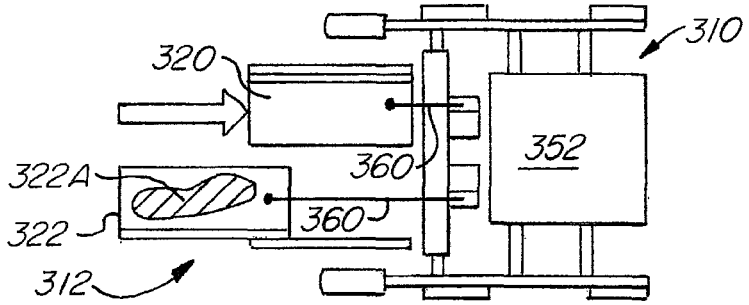
Figure 11D:
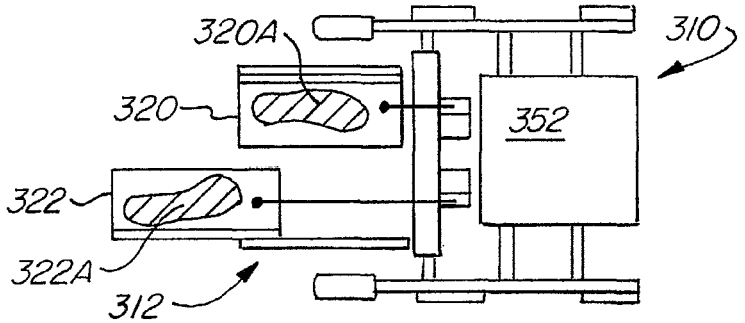
Figure 11E:
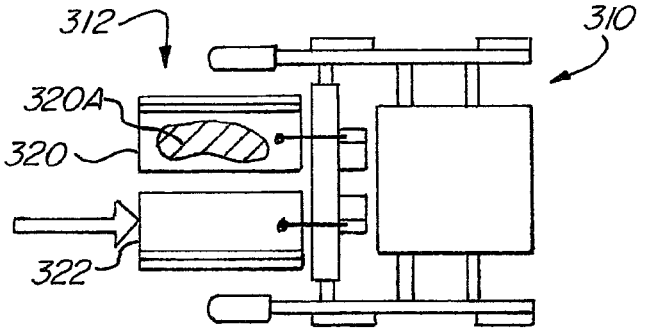
Figure 11F:
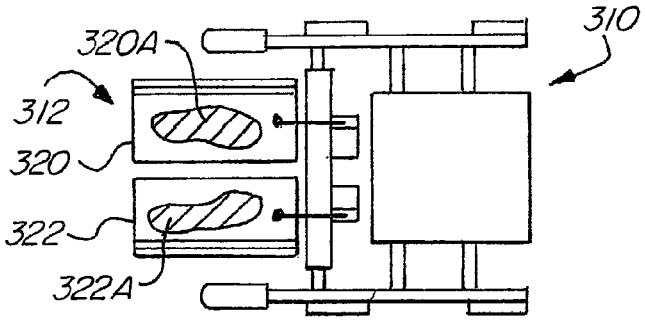

FIGS. 11A-F clearly illustrate the operation of the present invention as a user steps on a respective slip resistant surface 320 or 322. In FIG. 11A a user places their left foot on the slip resistant surface 320 and a right foot on the slip resistant surface 322. The foot image 320A represents pressure applied by the left foot and the foot image 322A represents pressure applied by the right foot. In FIG. 11A a user places their foot pressure on the slip resistant surface 320 and 322 while it is in a retracted position adjacent to the walker 310. FIG. 11B illustrates advancing the walker 310 forward so as to extend the retractable cords 360. FIG. 11C illustrates the removal of a user's left foot from the slip resistant surface 320 permitting the bias of the retractable cord 362 to move the slip resistant surface 320 towards and adjacent the walker 310. FIG. 11D illustrates the advancing and positioning of a user's left foot on the newly positioned slip resistant surface 320 in the taking of a step. FIG. 11E illustrates a use removing their right foot from the slip resistant surface 322 causing the slip resistant surface 322 to move towards and adjacent the walker 310. FIG. 11F illustrates a user moving their right foot into position onto slip resistant surface 322 in the takin of a step. This movement or stepping of the user is repeated as the walker 310 is moved forward. Accordingly, the present invention assures that a slip resistant surface 320 or 322 is positioned under a user's foot as the user advances the walker and steps forward. Therefore, the user is assured that they have secure footing when navigating slippery surfaces, such as water, snow, or ice.

The present invention therefore provides a means whereby any walker can be adapted to accommodate a slip resistant retractable surface attachment 312 that is easily and conveniently attached and removed. In slippery conditions, when needed the slip resistant retractable surface attachment 312 can be attached so as to provide a slip resistant surface 320 or 322 always in position under a person's foot providing secure footing. This provides substantial additional safety, particularly for an elderly person who may have compromised balance or strength.

What is claimed is:

1. An attachment to a walker for improving stability of a user on a slippery surface comprising:

an attachment bar;

means, coupled to said attachment bar, for attaching said attachment bar to the walker;

a slip resistant surface attached to said attachment bar; and a spring coupled between said attachment bar and said slip resistant surface, said spring biasing said slip resistant surface towards said attachment bar horizontally along the slippery surface, whereby said slip resistant surface is selectively positioned under the user's feet providing a stable surface to walk on.

2. An attachment to a walker for improving stability of a user as in claim 1 wherein:

said slip resistant surface comprises a first and second slip resistant surface for a respective on of the user's feet.

3. An attachment to a walker for improving stability of a user as in claim 1 wherein:

said means for attaching said attachment bar to the walker comprises an attachment hook placed on one end of said attachment bar adapted to attach to the walker.

4. A walker attachment for attaching to a walker comprising:

a first attachment bar;

a second attachment bar parallel to and spaced from said first attachment bar, whereby said first and second attachment bars are adapted to removably attach to the walker;

a first side member hingedly attached to said first attachment bar so as to pivot along a first vertical axis;

a first slip resistant surface slidablely and hingedly attached to said first side member so as to slide and pivot along a first horizontal axis, the first horizontal axis being perpendicular to the first vertical axis;

a first spring coupled to said first slip resistant surface, said first spring biasing said first slip resistant surface towards the walker;

a second side member hingedly attached to said second attachment bar so as to pivot along a second vertical axis;

a second slip resistant surface slidablely and hingedly attached to said second side member so as to slide and pivot along a second horizontal axis, the second horizontal axis being perpendicular to the second vertical axis; and a second spring coupled to said second slip resistant surface, said second spring biasing said second slip resistant surface towards the walker, whereby one of said first and second slip resistant surfaces is in position to receive a user's foot as the user moves the walker forward.

5. A walker attachment for attaching to a walker as in claim 4 wherein:

said first and second spring comprises a retractable cord.

6. A walker attachment for attaching to a walker as in claim 4 further comprising:

a plurality of removable cleats attached to said first and second slip resistant surfaces.

7. A walker attachment for attaching to a walker as in claim 6 further comprising:

a plurality of keyhole openings formed in said slip resistant surfaces adapted to accommodate said plurality of removable cleats.

8. A walker attachment for attaching to a walker as in claim 7 wherein:

each of said plurality of removable cleats comprises a cleat head, cleat body, cleat base, and cleat spikes wherein said cleat head and cleat base pass through a portion of one of said plurality of keyholes and said cleat body is held in another portion of said plurality of keyholes.

9. An attachment to a walker comprising:

a first attachment bar;

a second attachment bar spaced apart from and parallel to said first attachment bar;

an first attachment hook placed on one end of said first attachment bar, said first attachment hook adapted to attach to the walker;

an second attachment hook placed on one end of said second attachment bar, said second attachment hook adapted to attach to the walker;

an upper support bar extending between said first and second attachment bars perpendicular thereto;

a lower support bar extending between said first and second attachment bars perpendicular thereto and spaced from said upper support bar;

a first retractable cord spring attached between and to said upper and lower support bars;

a first retractable cord attached to said first retractable cord spring, said first retractable cord spring biasing a distal end of said first retractable cord towards the walker;

a first loop place on the distal end of said first retractable cord;

a second retractable cord spring attached between and to said upper and lower support bars;

a second retractable cord attached to said second retractable cord spring, said second retractable cord spring biasing a distal end of said second retractable cord towards the walker;

a second loop place on the distal end of said first retractable cord;

a first side member hingedly attached to said first attachment bar so as to pivot along a first vertical axis;

a first slip resistant surface slidablely and hingedly attached to said first side member so as to slide and pivot along a first horizontal axis, the first horizontal axis being perpendicular to the first vertical axis;

a first plurality of cleats attached to said first slip resistant surface;

a first hook placed on said first slip resistant surface, said first hook adapted to selectively hold said first loop placed on the distal end of said first retractable cord;

a second side member hingedly attached to said second attachment bar so as to pivot along a second vertical axis;

a second slip resistant surface slidablely and hingedly attached to said second side member so as to slide and pivot along a second horizontal axis, the second horizontal axis being perpendicular to the second vertical axis;

a second plurality of cleats attached to said second slip resistant surface; and a second hook placed on said second slip resistant surface, said second hook adapted to selectively hold said second loop placed on the distal end of said second retractable cord, whereby when said first and second side members are pivoted open away from the walker and said first and second slip resistant surfaces are folded down away from said first and second side members and said first loop is attached to said first hook and said second loop is attached to said second hook said first and second slip resistant surfaces alternately move away from the walker when a user steps thereon and towards the walker when a user removes their foot therefrom positioning said first and second slip resistant surfaces for the user to step on.

* * * * *